US009279250B2

(12) United States Patent
Wiker

(10) Patent No.: US 9,279,250 B2
(45) Date of Patent: Mar. 8, 2016

(54) LOW DENSITY ACOUSTICAL PANELS

(71) Applicant: Armstrong World Industries, Inc., Lancaster, PA (US)

(72) Inventor: Anthony L. Wiker, Lancaster, PA (US)

(73) Assignee: Awi Licensing Company, Wilmington, DE (US)

( * ) Notice: Subject to any disclaimer, the term of this patent is extended or adjusted under 35 U.S.C. 154(b) by 120 days.

(21) Appl. No.: 14/140,177

(22) Filed: Dec. 24, 2013

(65) Prior Publication Data

US 2015/0176279 A1 Jun. 25, 2015

(51) Int. Cl.

| | |
|---|---|
| ***E04B 1/84*** | (2006.01) |
| ***E04B 9/00*** | (2006.01) |
| ***G10K 11/162*** | (2006.01) |
| ***D04H 1/4209*** | (2012.01) |
| ***D04H 1/541*** | (2012.01) |
| *E04B 1/74* | (2006.01) |
| *E04B 1/76* | (2006.01) |

(52) U.S. Cl.

CPC ..... *E04B 9/001* (2013.01); *D04H 1/4209* (2013.01); *D04H 1/541* (2013.01); *G10K 11/162* (2013.01); *E04B 2001/742* (2013.01); *E04B 2001/7687* (2013.01)

(58) Field of Classification Search

CPC ..... E04B 1/8209; E04B 1/84
USPC ..... 181/294
See application file for complete search history.

(56) References Cited

U.S. PATENT DOCUMENTS

| | | | | |
|---|---|---|---|---|
| 4,476,175 | A | 10/1984 | Forry et al. | |
| 5,841,081 | A * | 11/1998 | Thompson et al. | 181/286 |
| 7,291,239 | B2 | 11/2007 | Polanco et al. | |
| 8,496,088 | B2 * | 7/2013 | Kitchen et al. | 181/290 |
| 8,544,218 | B2 * | 10/2013 | Dellinger et al. | 52/144 |
| 2003/0060113 | A1 | 3/2003 | Christie et al. | |
| 2003/0134556 | A1 | 7/2003 | Christie et al. | |
| 2004/0023014 | A1 | 2/2004 | Williamson et al. | |
| 2004/0065507 | A1 * | 4/2004 | Jacobsen | 181/290 |
| 2004/0077247 | A1 | 4/2004 | Schmidt et al. | |
| 2004/0161993 | A1 | 8/2004 | Tripp et al. | |
| 2005/0026527 | A1 | 2/2005 | Schmidt et al. | |
| 2010/0146887 | A1 | 6/2010 | Wiker et al. | |
| 2010/0320029 | A1 | 12/2010 | Cao et al. | |
| 2011/0028062 | A1 | 2/2011 | Chester et al. | |
| 2011/0089593 | A1 | 4/2011 | Miyauchi et al. | |
| 2012/0216975 | A1 | 8/2012 | Forlino et al. | |
| 2013/0029555 | A1 | 1/2013 | Morimoto | |

FOREIGN PATENT DOCUMENTS

| | | | |
|---|---|---|---|
| EP | 0357287 | B1 | 11/1994 |
| EP | 2434038 | | 3/2012 |
| JP | H0922374 | | 1/1997 |
| WO | 0123655 | A1 | 4/2001 |
| WO | 2005080659 | A1 | 9/2005 |
| WO | 2010/148416 | A2 | 12/2010 |

OTHER PUBLICATIONS

Extended European Search Report and Opinion for corresponding EP Application No. 14199421.0, mailed May 26, 2015. EP.

AU Search Report for corresponding AU Application No. 2014274553, mailed Aug. 13, 2015. EP.

* cited by examiner

*Primary Examiner* — Forrest M Phillips

(74) *Attorney, Agent, or Firm* — Craig M Sterner

(57) ABSTRACT

Described herein are building products comprising crimped bicomponent fibers and a non-woven fabric, which demonstrate, inter alia, improved acoustical performance. Methods of making and using the building products are also described.

20 Claims, No Drawings

LOW DENSITY ACOUSTICAL PANELS

BACKGROUND

Conventional acoustic ceiling tile is a non-woven structure which may include a core composed of base fibers, fillers, and binders combined to form the ceiling tile structure. The base fibers can be natural or synthetic materials, e.g., mineral fibers. Typically mineral fiber substrates of acoustical ceiling panels are wet-formed and fall within the density range of 9-25 lb/ft$^3$. Their porosities range low from 50-89% and therefore sound absorption is lower with NRCs ranging 0.50-0.75 after finishing and decorating the surfaces. They are usually wet-formed, bound with starch, and require large amounts of energy to remove residual water from the forming process. Surfaces must then be sanded smooth and material is wasted.

There are existing dry-formed mineral fiber and fiber glass acoustical ceiling products in which the web is in the density range of the invention; however these webs are poorly formed with irregular formation and require expensive face scrims and back scrims to impart adequate product surface quality and sufficient rigidity for the panel to be self-supporting in the ceiling grid. Most often such webs are bound with a phenolic resin that emits formaldehyde in the manufacturing process and some residual from the product. Other non-formaldehyde reactive resins, i.e. acrylic acid esters, are beginning to be used as well, but they require excess heat to drive off solution water and to drive the reaction. They are difficult to apply and often complicate the web forming process.

Thus, there remains a need for highly acoustically absorptive ceiling tiles with sufficient rigidity and acceptable surface quality, which can be easily cut or molded into complex shapes or embossed with surface patterns; and also avoid the challenges provided by the use of certain binding resins. Embodiments of the present invention are directed to this and other ends.

SUMMARY

In some embodiments, the present invention provides an acoustical substrate, comprising: from about 5 to about 25 wt. % of a crimped bicomponent fiber; and from about 75 to about 95 wt. % of a non-woven fabric.

In some embodiments, the present invention provides methods of preparing an acoustical substrate comprising: providing a nonwoven fabric comprising a web; incorporating a crimped bicomponent fiber into said nonwoven fabric web; and exposing said web comprising said crimped bicomponent fiber to a heat source; wherein the substrate has a bulk density between about 1.5 lbs/ft$^3$ and about 3.5 lbs/ft$^3$. In some embodiments, the present invention provides methods of reducing noise in a dwelling.

DETAILED DESCRIPTION

In some embodiments, the present invention provides an acoustical substrate, comprising: from about 5 to about 25 wt. % of a crimped bicomponent fiber; and from about 75 to about 95 wt. % of a nonwoven fabric. In some embodiments, the bicomponent fiber is a heat-fusible bicomponent fiber.

In some embodiments, the bicomponent fiber comprises two thermoplastic polymers having two different melting temperatures. Suitable thermoplastic polymers include olefinic polymers, e.g., polyethylene and polypropylene; polyesters, e.g., polyethylene terephthalate, polybutylene terephthalate; nylons, e.g., nylon 6 and nylon 6,6; thermoplastic elastomers, e.g., SBS and ABS. In some embodiments, the bicomponent fiber comprises a first component bicomponent to a second component. In some embodiments, the first component comprises an olefinic polymer. In some embodiments, the second component comprises an olefinic polymer. In other embodiments, at least one of the first component and the second component is a thermoplastic olefinic polymer. In further embodiments, the centers of gravity of the first and second components of the bicomponent fiber are mutually different in the fiber cross section.

In some embodiments, the olefinic resin of the first component is selected from: polypropylene, a copolymer of propylene and an α-olefin; an ethylene polymer; and polymethyl pentene. In some embodiments, the olefinic resin of the second component is selected from: polypropylene, a copolymer of propylene and an α-olefin; an ethylene polymer; and polymethyl pentene.

In some embodiments, the α-olefin is selected from ethylene; butene-1, octane; 4-methyl pentene; polyethylene terephthalate; and polyethylene terephthalate-glycol. In other embodiments, the ethylene polymer is selected from high-density polyethylene; medium-density polyethylene; low-density polyethylene; and linear low-density polyethylene. In some embodiments, the components of the bicomponent fiber are selected from polyethylene terephthalate, glycol-modified polyethylene terephthalate and polybutylene.

In some embodiments, the first component further comprises an additive. In some embodiments, the second component further comprises an additive. In some embodiments, the additive is selected from an antioxidant; a light stabilizer; a UV absorbent; a neutralizer; a nucleating agent; a lubricant; a bactericide; a deodorizing agent; a flame retardant; an antistatic agent; a pigment; and a plasticizer.

In some embodiments, the melting point of the first component is not greater than about 150° C. In some embodiments, the melting point of the first component is from about 80° C. to about 150° C. In some embodiments, the melting point of the first component is from about 120° C. to about 145° C.

In some embodiments, the melting point of the second component is not greater than about 200° C. In some embodiments, the melting point of the second component is from about 140° C. to about 200° C. In some embodiments, the melting point of the second component is from about 155° C. to about 170° C. In some embodiments, the melting point of the second component is greater than the melting point of the first component.

In some embodiments, the difference in melting points between the first component and the second component is from about 10° C. to about 40° C. In some embodiments, the difference in melting points between the first component and the second component is from about 20° C. to about 30° C.

In some embodiments, the length of the bicomponent fiber is from about 3 mm to about 30 mm. In other embodiments, the length of the bicomponent fiber is from about 6 mm to about 25 mm.

In some embodiments, the two components of the bicomponent fiber has a configuration selected from concentric sheath-core, eccentric sheath-core and side-by-side. In some embodiments, the fiber has a concentric sheath-core configuration. In some embodiments, the first component comprises from about 25 to about 75 wt. %, of the bicomponent fiber and the second component comprises from about 25 to about 75 wt. % of the bicomponent fiber. In some embodiments, the first component comprises from about 35 to about 65 wt. %, of the bicomponent fiber and the second component comprises from about 35 to about 65 wt. % of the bicomponent fiber. In some embodiments, the first component comprises from about 40 to about 60 wt. %, of the bicomponent fiber and the second component comprises from about 40 to about 60 wt. % of the bicomponent fiber. In some embodiments, the first component comprises about 50 wt. %, of the bicomponent fiber and the second component comprises about 50 wt. % of the bicomponent fiber.

In some embodiments, the second component comprises a plurality of filaments. In some embodiments, the filaments are about 2 denier to about 4 denier.

In some embodiments, the acoustical substrate provides a NRC of greater than about 0.50. In some embodiments, the acoustical substrate provides a NRC of greater than about 0.55. In some embodiments, the acoustical substrate provides a NRC of greater than about 0.60. In some embodiments, the acoustical substrate provides a NRC of greater than about 0.65. In some embodiments, the acoustical substrate provides a NRC of greater than about 0.70. In some embodiments, the acoustical substrate provides a NRC of greater than about 0.75. In some embodiments, the acoustical substrate provides a NRC of greater than about 0.80. In some embodiments, the acoustical substrate provides a NRC of greater than about 0.85. In some embodiments, the acoustical substrate provides a NRC of greater than about 0.90. In some embodiments, the acoustical substrate provides a NRC of about 0.95. In some embodiments, the acoustical substrate provides a NRC of greater than about 0.95.

In some embodiments, the bulk density of the acoustical substrate is between about 1 to about 4 lbs./ft$^3$. In some embodiments, the bulk density of the acoustical substrate is between about 1.5 to about 3.5 lbs/ft$^3$. In some embodiments, the bulk density of the acoustical substrate is between about 1.75 to about 2.5 lbs/ft$^3$.

In some embodiments, the acoustical substrate comprises from about 10 to about 20 wt. % of a bicomponent fiber. In some embodiments, the acoustical substrate comprises from about 80 to about 90 wt. % of mineral wool. In some embodiments, the acoustical substrate comprises from about 10 to about 20 wt. % of a bicomponent fiber; and from about 80 to about 90 wt. % of mineral wool. In some embodiments, the acoustical substrate comprises from about 12 to about 17 wt. % of a bicomponent fiber. In some embodiments, the acoustical substrate comprises from about 83 to about 88 wt. % of mineral wool. In some embodiments, the acoustical substrate comprises from about 12 to about 17 wt. % of a bicomponent fiber; and from about 83 to about 88 wt. % of mineral wool. In some embodiments, glassfiber or a mixture of glassfiber and mineral wool is used in place of mineral wool.

In some embodiments, the bicomponent fiber is crimped in a planar zig-zag or spiral shape. In some embodiment the bicomponent fiber is crimped in a zig-zag shape. In some embodiments, the bicomponent fiber has a crimp shape index of from about 1 to about 2. In some embodiments, the bicomponent fiber has a crimp shape index of from about 1.05 to about 1.60. The crimp shape index values provided herein are calculated using the following formula: actual length of short fiber/distance between both ends of the crimped fiber. In some embodiments, the bicomponent fiber has between about 5 and 15 crimps/inch. In some embodiment, the bicomponent fiber has between about 7 and 10 crimps/inch.

In some embodiments, the acoustical substrate is prepared by way of an air laying process.

In some embodiments, the non-woven fabric is selected from mineral wool; slag wool; and rock wool, and a combination of two or more thereof. In some embodiments, the non-woven fabric comprises mineral wool.

In some embodiments, the substrate is formaldehyde free.

In further embodiments, the substrate is a tile. In other embodiments, the substrate is a ceiling tile. In some embodiments, the acoustical substrate further comprises a scrim.

Some embodiments of the present invention provide methods of preparing an acoustical substrate comprising: providing a nonwoven fabric comprising a web; incorporating a crimped bicomponent fiber into said nonwoven fabric web; and heating said web comprising said crimped bicomponent fiber.

Some embodiments of the present invention provide a method of forming an acoustical panel comprising: providing a crimped bicomponent fiber having a sheath layer surrounding an inner core; dispersing and mixing said bicomponent fiber with mineral wool to form a fibrous batt; heating the fibrous batt; and softening the sheath layer to form a matrix of crimped fiber, forming the acoustical panel.

In some embodiments, the sheath layer comprises a first polymer and the inner core comprises a second polymer. In some embodiments, the first polymer has a melting point lower than a melting point of a second polymer which comprises the inner core.

In some embodiments, the bicomponent fiber and the nonwoven fabric are mixed and dispersed in a high velocity air stream. In some embodiments, the fibrous batt is heated to a temperature above the melting temperature of the first polymer and below the melting temperature of the second polymer.

In some embodiments, the methods further comprise the step of consolidating the formed acoustical panel. In some embodiments, the formed acoustical panel is consolidated by sequential heating and cooling. Some embodiments further comprise the step of pressing the formed acoustical panel. In some embodiments, the acoustical panel is form cured.

EXAMPLES

Example 1

An exemplary substrate of the present invention is prepared by dispersing a crimped bicomponent fiber having a concentric sheath-core configuration having a zig-zag pattern, wherein the sheath layer comprises coPET and the inner core layer comprises PET, in a batt of mineral wool; mixing the crimped bicomponent fiber with the batt; and heating the fibrous batt to a temperature of about 110° C. to melt the sheath layer of the crimped bicomponent fiber.

Example 2

Various substrates are prepared as described in Table 1 (below). The data described in Table 1 highlights the impact that length and crimping have on web loft.

TABLE 1

| | Core/Sheath | Dimensions | Crimp | Basis Weight (gsm) | Web Thickness (in) | Web Density (lb/ft$^3$) |
|---|---|---|---|---|---|---|
| Ex 1 | co-PET/PET | 6 mm × 2 d | None | 1546 | ⅞ | 4.34 |
| Ex 2 | co-PET/PET | 6 mm × 2 d | 7/inch | 1527 | 1½ | 2.46 |
| Ex 3 | co-PET/PET | 22 mm × 4 d | 10/inch | 1235 | 1¾ | 1.74 |
| Ex 4 | co-PET/PET | 50 mm | | 1500 | unable to form web | — |

The data described in Table 1 demonstrates that acoustical substrates comprising the claimed combination of a crimped bicomponent fiber and a mineral batt provide an unexpected improvement in web loft, which would thus provide an unexpected improvement in acoustical performance.

The invention claimed is:

1. An acoustical substrate, comprising:

about 5 to about 25 wt. % of a crimped bicomponent fiber having a length greater than 3 mm and up to 30 mm; and about 75 to about 95 wt. % of an inorganic fiber batt;

wherein the density of the acoustical substrate ranges from about 1 $lb/ft^3$ to about 4 $lb/ft^3$.

2. The acoustical substrate of claim 1, wherein the bicomponent fiber is a heat-fusible bicomponent fiber.

3. The acoustical substrate of claim 1, wherein the bicomponent fiber comprises a first component and a second component.

4. The acoustical substrate of claim 3, wherein the first component comprises a thermoplastic polymer.

5. The acoustical substrate of claim 3, wherein the second component comprises a second thermoplastic polymer.

6. The acoustical substrate of claim 3, wherein at least one of the first component and the second component is a thermoplastic olefinic polymer.

7. The acoustical substrate of claim 6, wherein the olefinic polymer of the first component is selected from: polypropylene, a copolymer of propylene and an α-olefin; an ethylene polymer; and polymethyl pentene; and wherein the olefinic polymer of the second component is selected from: polypropylene, a copolymer of propylene and an α-olefin; and an ethylene polymer.

8. The acoustical substrate of claim 1, wherein the first and second components comprise a polyester.

9. The acoustical substrate of claim 8, wherein the polyester is selected from polyethylene terephthalate, glycol-modified terephthalate and polybutylene terephthalate.

10. The acoustical substrate of claim 3, wherein the second component has a melting point higher than that of the first component.

11. The acoustical substrate of claim 3, wherein the melting point of the first component is not greater than about 150° C.

12. The acoustical substrate of claim 11, wherein the melting point of the second component is not greater than about 200° C.

13. The acoustical substrate of claim 1, wherein the crimped bicomponent fiber is in a planar zig-zag or spiral shape.

14. The acoustical substrate of claim 1, wherein the first component comprises from about 40 to about 60 wt. %, of the bicomponent fiber and the second component comprises from about 40 to about 60 wt. % of the bicomponent fiber.

15. The acoustical substrate of claim 3, wherein the second component comprises a plurality of filaments.

16. The acoustical substrate of claim 1, comprising from about 12 to about 17 wt. % of a bicomponent fiber.

17. The acoustical substrate of claim 16, comprising from about 83 to about 88 wt. % of mineral wool.

18. The acoustical substrate of claim 1, wherein the substrate is a ceiling tile.

19. The acoustical substrate of claim 1, further comprising a scrim.

20. An acoustical substrate, comprising:

about 5 to about 25 wt. % of a crimped bicomponent fiber having a length ranging from about 6 mm to about 30 mm; and about 75 to about 95 wt. % of an inorganic fiber batt;

wherein the bicomponent fiber comprises a first component and a second component and the second component has a melting point higher than that of the first component.

* * * * *